US010415812B2

(12) United States Patent
Pavlik et al.

(10) Patent No.: US 10,415,812 B2
(45) Date of Patent: Sep. 17, 2019

(54) ELECTRICAL SWITCHES AND DEVICES UTILIZING SUCH SWITCHES

(71) Applicant: Dependalite, LLC, Hudson, OH (US)

(72) Inventors: Robert Pavlik, Hudson, OH (US); Shane L. Smith, Bellbrook, OH (US); David A. Pavlik, Hudson, OH (US)

(73) Assignee: DEPENDALITE, LLC, Hudson, OH (US)

( * ) Notice: Subject to any disclaimer, the term of this patent is extended or adjusted under 35 U.S.C. 154(b) by 145 days.

(21) Appl. No.: 15/713,748

(22) Filed: Sep. 25, 2017

(65) Prior Publication Data

US 2018/0087758 A1 Mar. 29, 2018

Related U.S. Application Data

(60) Provisional application No. 62/400,804, filed on Sep. 28, 2016.

(51) Int. Cl.

| | |
|---|---|
| ***F21V 23/04*** | (2006.01) |
| ***F21L 4/00*** | (2006.01) |
| ***F21L 4/02*** | (2006.01) |
| ***F21V 14/02*** | (2006.01) |
| ***F21V 23/00*** | (2015.01) |
| ***H01H 21/10*** | (2006.01) |

(52) U.S. Cl.

CPC ..... *F21V 23/0414* (2013.01); *F21L 4/005* (2013.01); *F21L 4/02* (2013.01); *F21V 14/025* (2013.01); *F21V 23/009* (2013.01); *H01H 21/10* (2013.01)

(58) Field of Classification Search

CPC .. F21V 23/0414; F21V 14/025; F21V 23/009; H01H 21/10; F21L 4/02; F21L 4/005

USPC ..... 200/329, 330, 331, 332.2

See application file for complete search history.

(56) References Cited

U.S. PATENT DOCUMENTS

| | | | |
|---|---|---|---|
| 1,375,586 | A | 4/1921 | Graves |
| 2,687,508 | A | 8/1954 | Noyes |
| 3,870,843 | A | 3/1975 | Witte |
| 3,885,148 | A | 5/1975 | Di Benedetto |
| 4,151,583 | A | 4/1979 | Miller |
| 4,333,129 | A | 6/1982 | Ewing |
| 4,670,629 | A | 6/1987 | Vanbenthuysen et al. |

(Continued)

FOREIGN PATENT DOCUMENTS

CN 201496781 U 6/2010

OTHER PUBLICATIONS

International Search Report and Written Opinion for application No. PCT/US17/53471, dated Nov. 30, 2017; 14 pages.

(Continued)

*Primary Examiner* — Edwin A. Leon
*Assistant Examiner* — Lheiren Mae A Caroc
(74) *Attorney, Agent, or Firm* — Rankin, Hill & Clark LLP; Mark E. Bandy

(57) ABSTRACT

Electrical switch assemblies are described which include multiple switch bars. Each switch bar provides both physical and electrical separation between adjacent electrical components. Also, described are battery powered devices using the switch assemblies. Examples of devices using the switch assemblies include flashlights and remote control devices. The devices and switch assemblies avoid parasitic battery drain.

20 Claims, 7 Drawing Sheets

(56) References Cited

U.S. PATENT DOCUMENTS

| | | | | |
|---|---|---|---|---|
| 4,750,095 | A | 6/1988 | Huang | |
| 6,074,778 | A | 6/2000 | Stagakis | |
| 6,989,502 | B1 | 1/2006 | Lu | |
| D530,439 | S | 10/2006 | Maglica | |
| 7,265,305 | B2 * | 9/2007 | Chiu | H01H 3/12 200/331 |
| RE40,125 | E | 3/2008 | Matthews et al. | |
| 8,096,674 | B2 | 1/2012 | Matthews et al. | |
| 8,833,963 | B2 | 9/2014 | Opolka | |
| 2004/0190286 | A1 | 9/2004 | Chapman | |
| 2006/0138868 | A1 | 6/2006 | Wareham et al. | |
| 2007/0258236 | A1 | 11/2007 | Miller | |
| 2011/0103047 | A1 | 5/2011 | Gross et al. | |
| 2016/0245466 | A1 | 8/2016 | Law et al. | |

OTHER PUBLICATIONS https://www.coleman.com/divide-250l-led-flashlight/2000020045.html ; DIVIDE™ 250L LED Flashlight (2 pages).

* cited by examiner

ELECTRICAL SWITCHES AND DEVICES UTILIZING SUCH SWITCHES

CROSS REFERENCES TO RELATED APPLICATIONS

This application claims priority from U.S. provisional application Ser. No. 62/400,804 filed on Sep. 28, 2016.

FIELD

The present subject matter relates to electrical switches and devices utilizing such switches. In particular, the present subject matter is directed to battery powered devices such as flashlights utilizing the switches.

BACKGROUND

It is a common occurrence for flashlights to not be ready in an emergency. This is typically due to either drained batteries, or batteries that have corroded and/or leaked their contents resulting in damage to the flashlight.

At present, most batteries are designed to retain an electrical charge in storage for 7 to 10 years. However, when batteries are placed in a flashlight, their connection with the electrical components in the flashlight typically causes a slow drain of electrical charge from the batteries. This phenomenon is sometimes referred to as "parasitic battery drain." Consequently, when the flashlight is needed such as during a storm or other event which causes an electrical or power outage, the flashlight is dim or inoperable.

One could leave the batteries out of the flashlight to preserve their charge. However, it is often difficult to install batteries in a flashlight so that the batteries are arranged in their proper orientation in the flashlight particularly when the environment is dark such as during a power outage.

Another problem and potentially even more significant, is when batteries leak corrosive agents within the flashlight. The resulting damage typically destroys the flashlight or renders the flashlight permanently unusable. Although such leakage can occur independently of parasitic battery drain, in many instances the resulting corrosion of electrical components can be increased due to the battery drain.

Accordingly, a need exists for a strategy for avoiding or at least significantly reducing the potential for parasitic battery drain in devices. And, a need exists for such devices and in particular, flashlights which avoid or which are less susceptible to parasitic battery drain.

SUMMARY

The difficulties and drawbacks associated with previous approaches are addressed in the present subject matter as follows.

In one aspect, the present subject matter provides an electrical switch assembly positionable to a plurality of different switch states. The switch assembly comprises a plurality of slidably positionable switch bars. Each switch bar defines a first end, a second end opposite from the first end, and oppositely directed faces extending between the first end and the second end. Each switch bar includes an electrically conducting region, and an electrically insulating region. The switch assembly also comprises a first push member engaged with the first end of each switch bar, and a second push member engaged with the second end of each switch bar. The switch assembly is positionable to an on state by linearly displacing the plurality of the switch bars, the first push member, and the second push member in a first direction. And the switch assembly is positionable to an off state by linearly displacing the plurality of the switch bars, the first push member, and the second push member in a second direction.

In another aspect, the present subject matter provides a device having a selectively actuated electrical component. The device comprises at least one electrical component that is actuatable upon receiving electrical power. The device also comprises an electrical switch assembly positionable between at least an on state and an off state, and in electrical communication with the electrical component. The electrical switch assembly includes a plurality of slidably positionable switch bars. Each switch bar defines a first end, a second end opposite from the first end, and oppositely directed faces extending between the first end and the second end. Each switch bar also includes an electrically conducting region, and an electrically insulating region. The electrical switch assembly also includes a first push member engaged with the first end of each switch bar, and a second push member engaged with the second end of each switch bar. The switch assembly is positionable to an on state by linearly displacing the plurality of the switch bars, the first push member, and the second push member in a first direction, and the switch assembly is positionable to an off state by linearly displacing the plurality of the switch bars, the first push member, and the second push member in a second direction.

In yet another aspect, the present subject matter also provides a selectively actuated electrical device comprising an enclosure defining an interior hollow region. The electrical device also includes at least one electrical component disposed at least partially within the enclosure that is actuatable upon receiving electrical power. And, the electrical device additionally includes an electrical switch assembly disposed at least partially within the enclosure. The switch assembly is positionable between at least an on state and an off state, and is in electrical communication with the electrical component. The electrical switch assembly includes (i) a plurality of slidably positionable switch bars, each switch bar defining a first end, a second end opposite from the first end, and oppositely directed faces extending between the first end and the second end, and each switch bar including an electrically conducting region, and an electrically insulating region; (ii) a first push member engaged with the first end of each switch bar, and (iii) a second push member engaged with the second end of each switch bar. The switch assembly is positionable to an on state by linearly displacing the plurality of the switch bars, the first push member, and the second push member in a first direction, and the switch assembly is positionable to an off state by linearly displacing the plurality of the switch bars, the first push member, and the second push member in a second direction.

As will be realized, the subject matter described herein is capable of other and different embodiments and its several details are capable of modifications in various respects, all without departing from the claimed subject matter. Accordingly, the drawings and description are to be regarded as illustrative and not restrictive.

DETAILED DESCRIPTION OF THE EMBODIMENTS

The present subject matter provides electrical devices which avoid or are less susceptible to parasitic battery drain as compared to conventional devices. In particular, the present subject matter also provides electrical switch assemblies that avoid parasitic battery drain when the switch assembly is incorporated in a device with one or more batteries. The electrical switch assemblies enable selection of one of a plurality of switch states including an ON state and an OFF state. The switch assemblies provide both physical and electrical separation between adjacent electrical components of a device such as electrical contacts and/or batteries. The switch assemblies include a collection of slidably positionable switch bars that extend between, and typically engaged with, two push members. The switch assemblies are slidably positioned between the ON and OFF states by linearly displacing the collection of switch bars and push members relative to the electrical components of the device. Each of the switch bars provides both physical and electrical separation of adjacent electrical components as described herein. The present subject matter also provides a wide array of devices utilizing the switch assembly.

Figure 1:
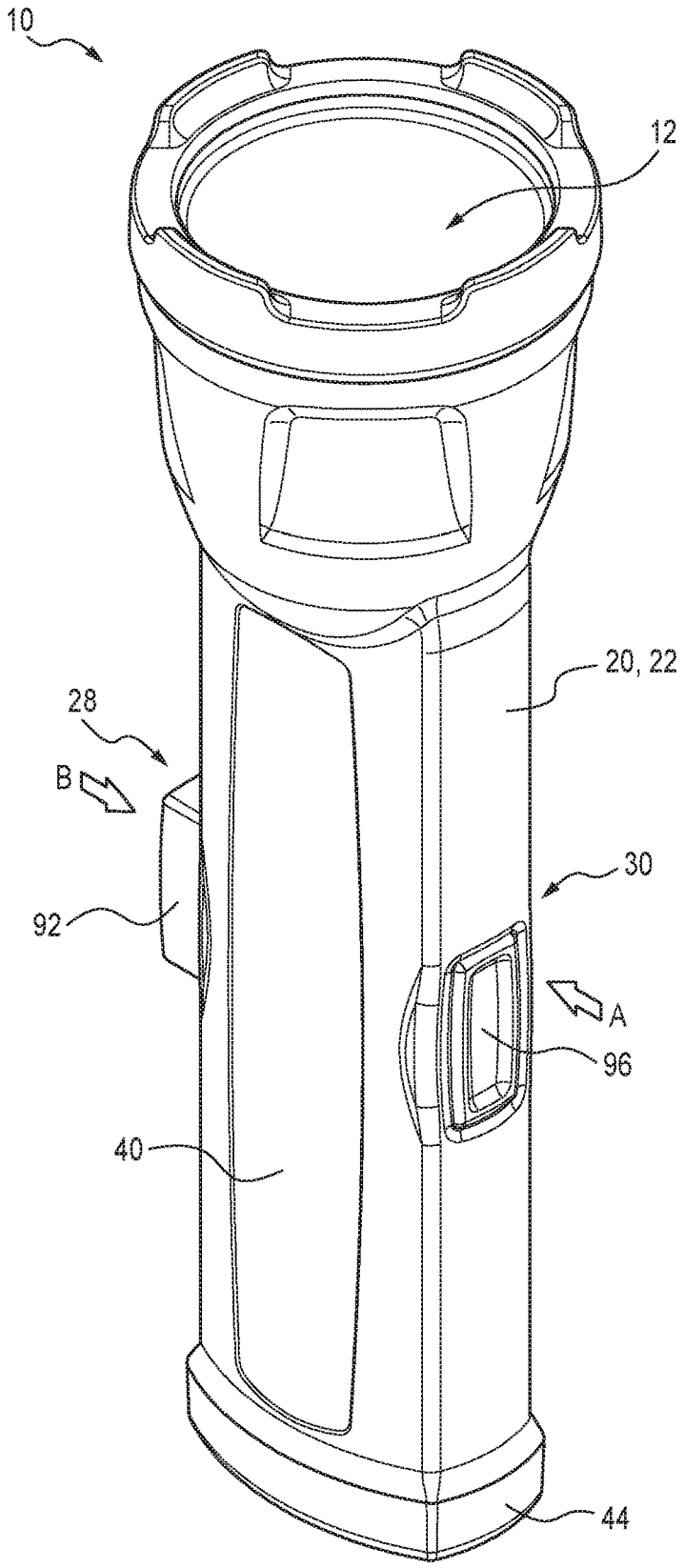
FIG. 1 is a perspective view of an embodiment of a flashlight utilizing a switch assembly in accordance with the present subject matter.
Figure 2:
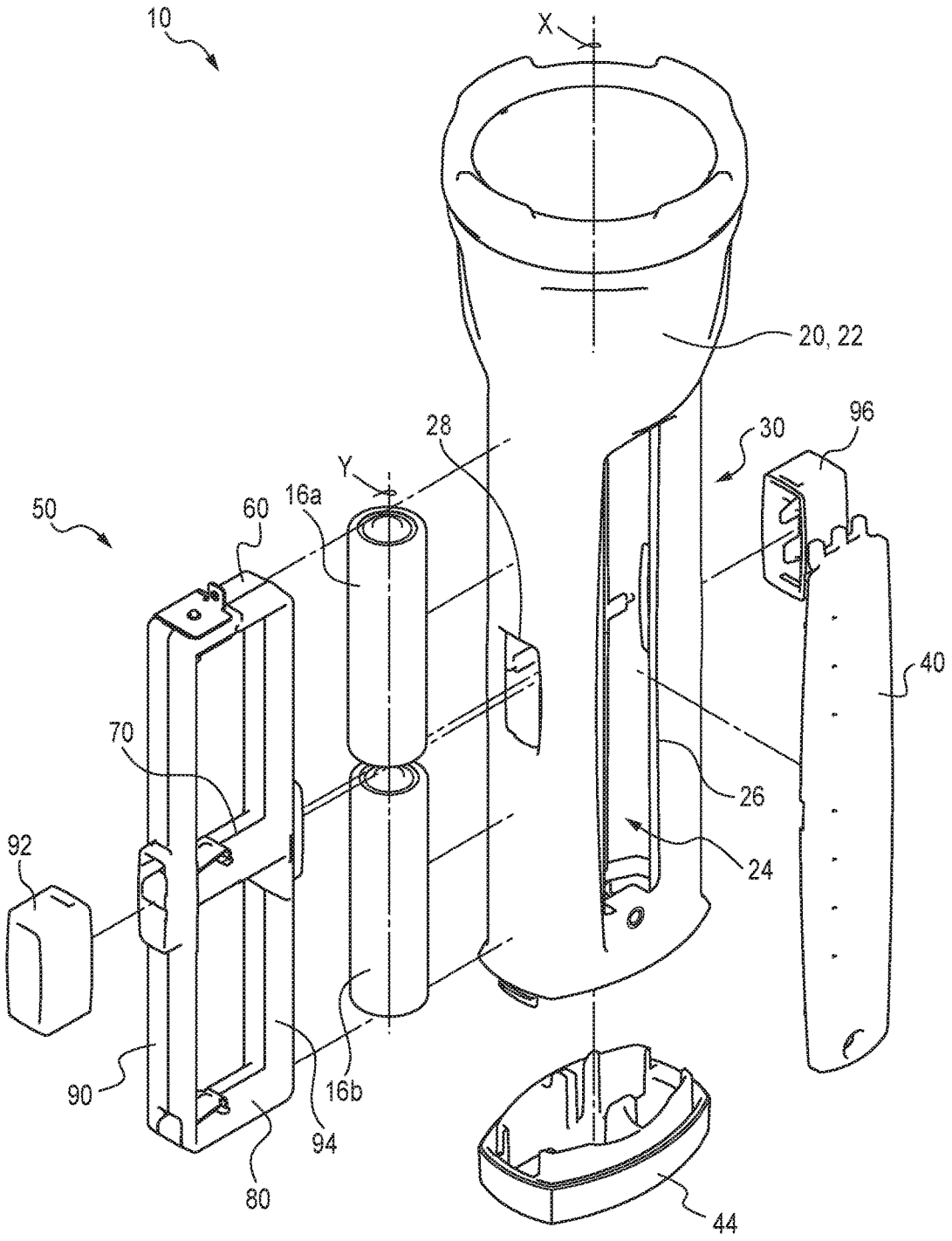
FIG. 2 is a schematic, partially exploded assembly view of the flashlight of FIG. 1 illustrating the switch assembly.

FIGS. 1 and 2 illustrate a flashlight 10 in accordance with the present subject matter. The flashlight 10 comprises an enclosure 20 having an enclosure wall 22 that defines an interior hollow region 24. The enclosure 20 can define one or more openings which provide access to the interior region 24 such as an opening 26 for accessing batteries described in greater detail herein, and actuator openings 28 and 30 for example. The flashlight includes one or more electrical components 12 such as a lightbulb or other light emitting component, one or more batteries shown as 16*a* and 16*b*, a switch assembly 50, and one or more removable cover(s) 40, and/or secondary covers or panels 44. The flashlight or more particularly the switch assembly 50 is actuated or de-actuated, by linear displacement of actuators 92, 96 in either direction A or B. All of these aspects are described in greater detail herein.

Referring further to FIG. 2, the switch assembly 50 is shown in greater detail. The switch assembly 50 comprises a plurality of switch bars which in the embodiment shown in the referenced figures, includes a first switch bar 60, a second switch bar 70, and a third switch bar 80. The switch assembly 50 also comprises a first push member 90 and a second push member 94. The push members 90, 94 are disposed at opposite ends of the switch bars. Typically, each of the switch bars 60, 70, and 80 are oriented parallel with each other and are joined to, affixed, or formed with, the push members 90, 94. And, in many versions, one or both of the push members 90, 94 are oriented transverse to one or more switch bars 60, 70, and/or 80. As will be appreciated, upon incorporation of the switch assembly 50 in the enclosure 20, the batteries 16*a*, 16*b* are positioned between the switch bars 60, 70, and 80; and the switch assembly 50 and batteries 16*a*, 16*b* are disposed within the interior hollow region 24 of the enclosure 20. In many embodiments, the batteries 16*a*, 16*b* are aligned along a common axis shown in FIG. 2 as axis Y. And, in many embodiments, upon incorporation in the enclosure 20, the axis Y of the batteries is collinear with a longitudinal axis X of the enclosure. It will be understood that the present subject matter is not limited to the particular arrangement described herein, and includes a wide array of arrangements of one or more batteries and device enclosures.

Figure 3:
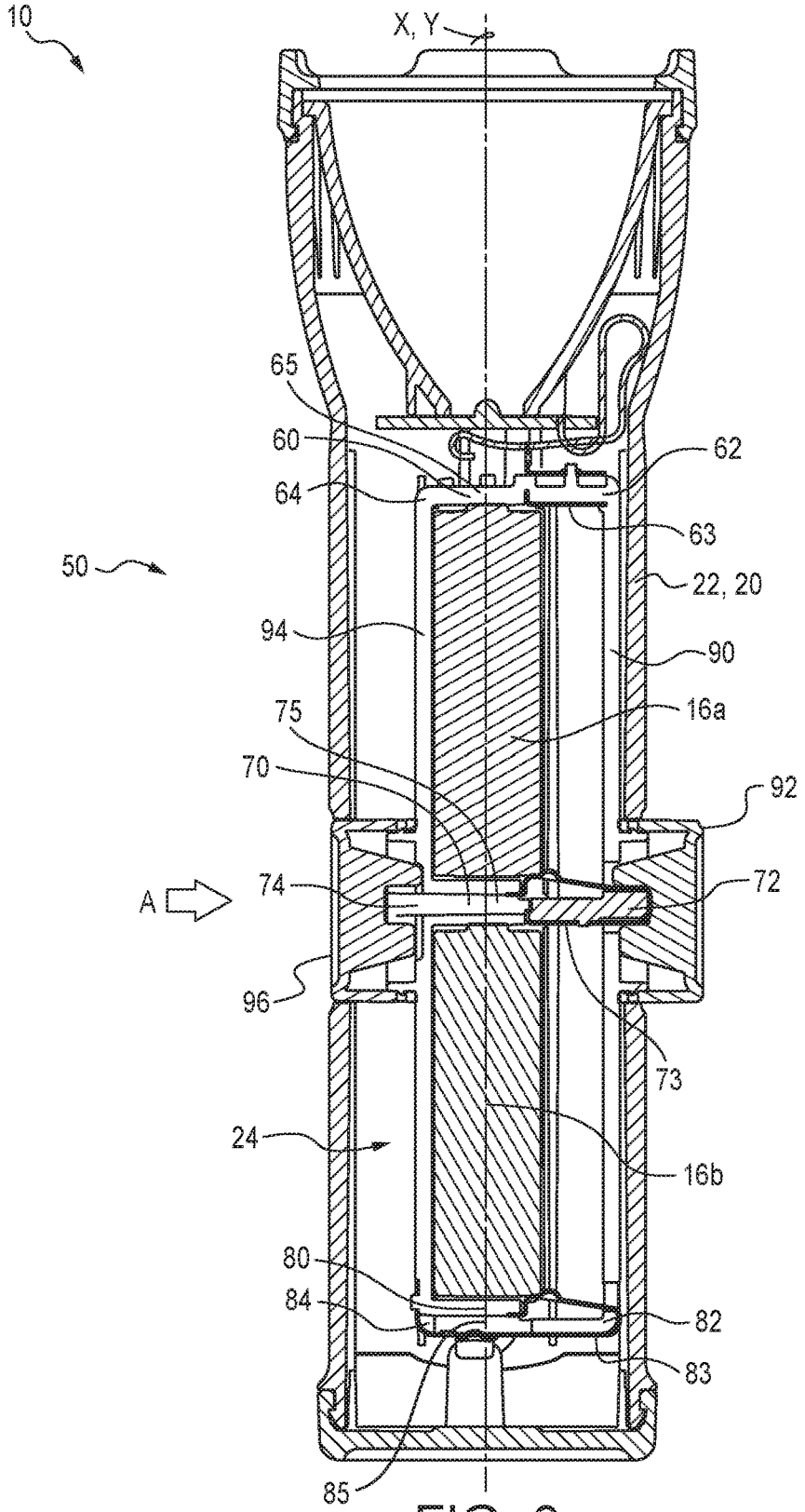
FIG. 3 is a schematic, partial cross sectional view of the flashlight and switch assembly of FIG. 1, in which the switch assembly is in an OFF state.
Figure 4:
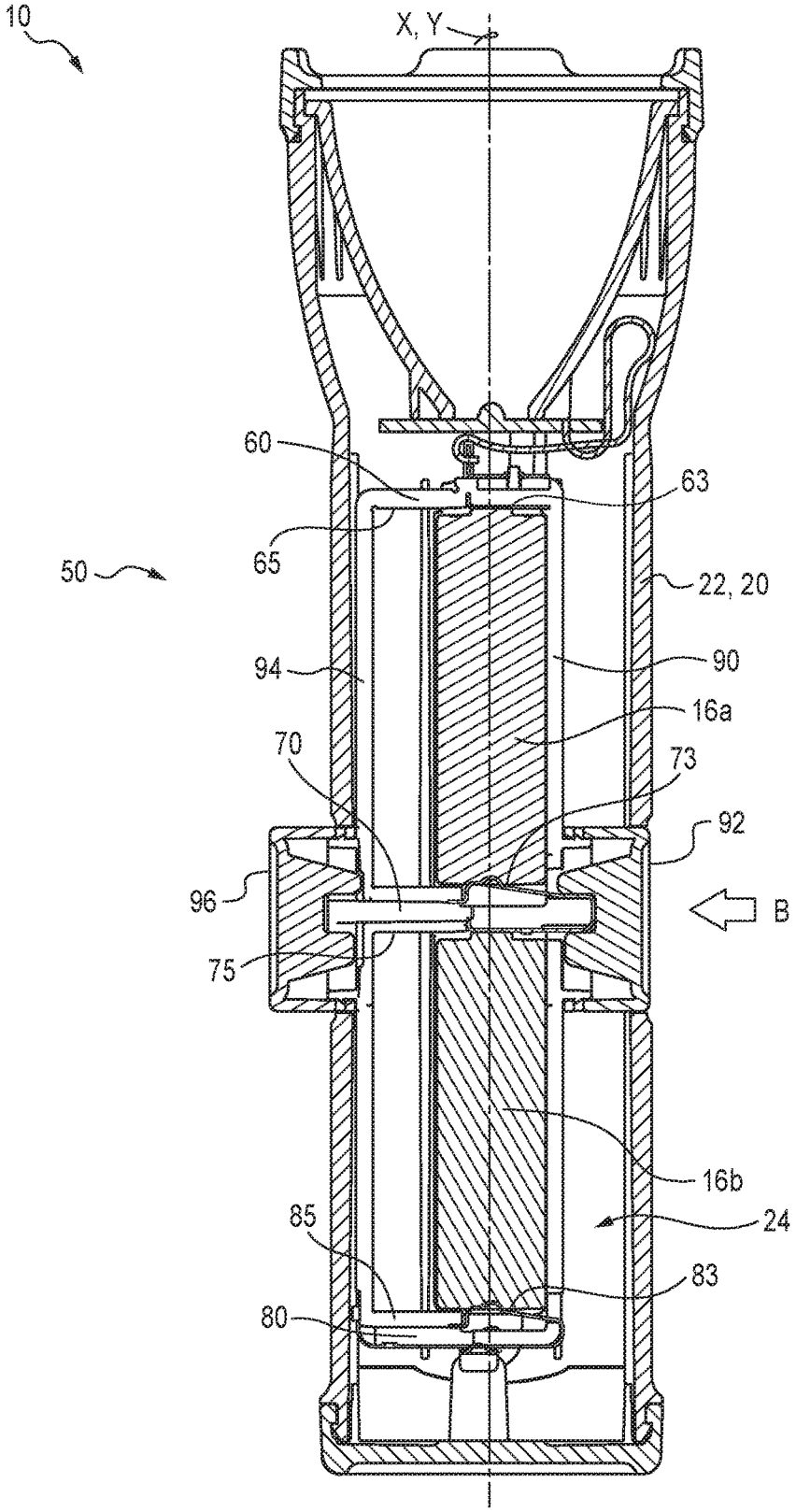
FIG. 4 is a schematic, partial cross sectional view of the flashlight and switch assembly of FIG. 1, in which the switch assembly is in an ON state.

FIGS. 3 and 4 are partial cross sectional views of the flashlight 10 showing additional aspects of the switch assembly 50 disposed within the enclosure 20. As will be understood, in the particular embodiment, upon incorporation of the batteries 16*a*, 16*b* in the enclosure 20, the axis Y of the batteries is collinear with the axis X of the enclosure. The switch assembly 50 and in particular its switch bars 60, 70, and 80 is linearly displaced between an OFF state shown in FIG. 3 and an ON state shown in FIG. 4. Displacement is achieved by urging the actuator 96 and push member 94 in the direction of arrow A to the OFF position shown in FIG. 3; and urging the actuator 92 and push member 90 in the direction of arrow B to the ON position shown in FIG. 4. In the present embodiment depicted in the referenced figures, the direction of movement or displacement of the switch assembly is parallel with the longitudinal axes of the switch bars. However, the present subject matter is not limited to such a configuration. For example, the present subject matter includes switch assemblies that are moved or displaced to different switch states such that the direction(s) of movements are not parallel with an axis of a switch bar, or axes of two or more switch bars.

In particular embodiments of the present subject matter, the enclosure and/or one or more cover(s) of the enclosure of the device are formed of an optically clear or transparent material to allow viewing of the contents of the enclosure therethrough. For example, referring to FIG. 1, the cover 40 and/or the enclosure 20 can be formed from an optically clear or otherwise sufficiently transparent material to allow inspection or viewing of the switch assembly 50 and/or the batteries disposed within the flashlight 10. However, the present subject matter includes forming one or more, or all, of the enclosure 20, the cover 40, and/or other related portions of the device from materials that are translucent or opaque.

Figure 6:
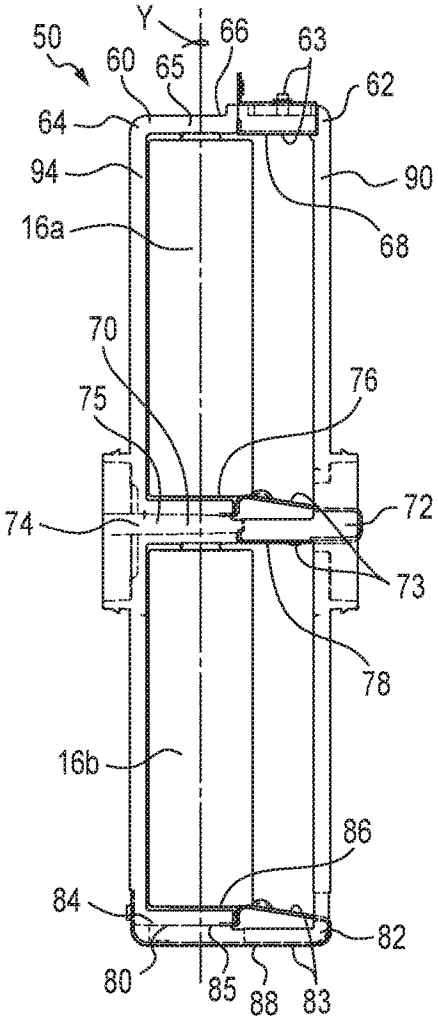
FIG. 6 is a schematic, side elevational view of the switch assembly and batteries, in which the switch assembly is in an OFF state.
Figure 5:
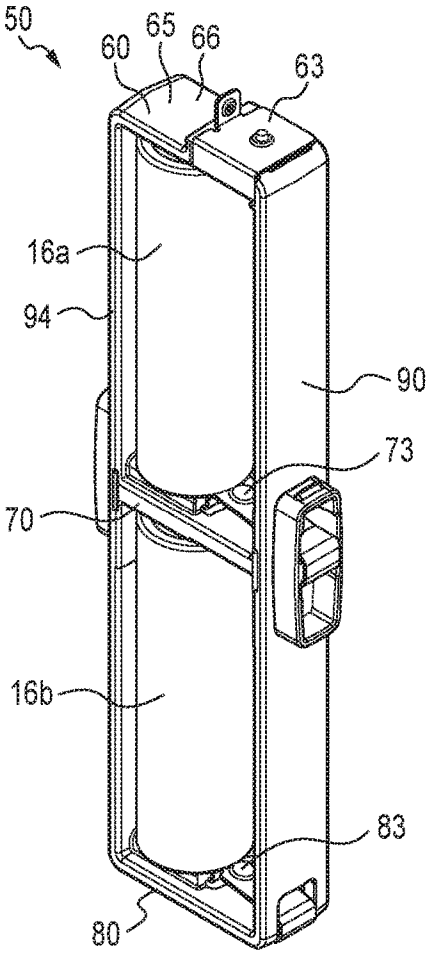
FIG. 5 is a perspective view of the switch assembly shown with batteries, in which the switch assembly is in an OFF state.
Figure 8:
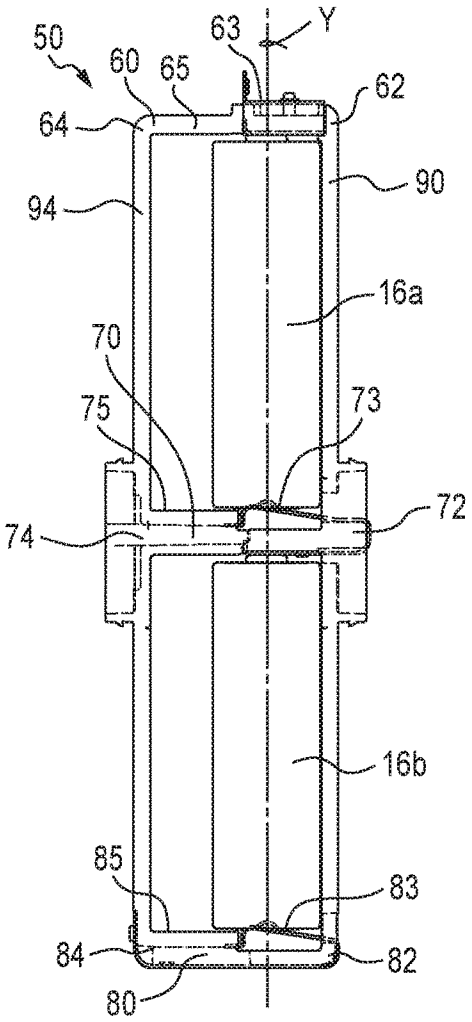
FIG. 8 is a schematic, side elevational view of the switch assembly and batteries, in which the switch assembly is in an ON state.
Figure 7:
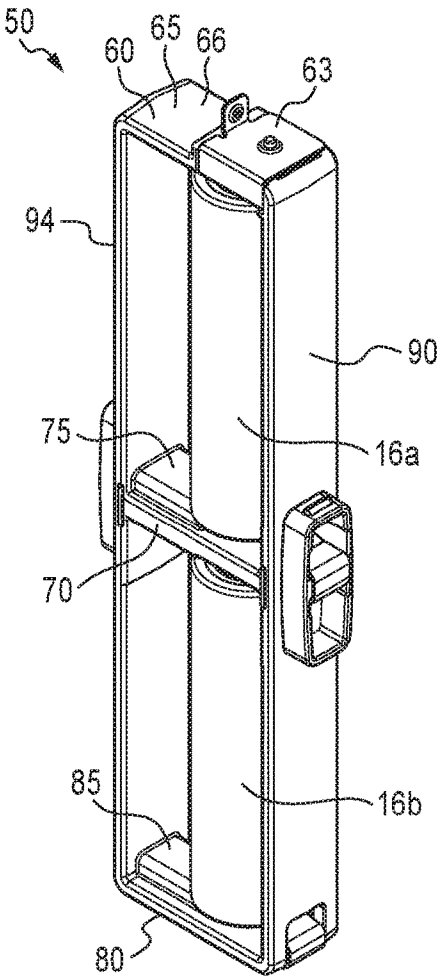
FIG. 7 is a perspective view of the switch assembly shown with batteries, in which the switch assembly is in an ON state.

FIGS. 5-8 illustrate additional details and aspects of the switch assembly 50. The switch 50 is shown in conjunction with batteries 16*a*, 16*b* to facilitate understanding of the operation and components of the switch 50. FIGS. 5 and 6 depict the switch 50 in an OFF state. FIGS. 7 and 8 depict the switch 50 in an ON state. Each of the switch bars includes particular features as follows. The first switch bar 60 defines a first end 62 and a second opposite end 64. The first switch bar 60 defines oppositely directed faces 66 and 68 extending between the ends 62, 64. The first switch bar 60 includes an electrically conductive region 63 and an electrically insulating region 65. The second switch bar 70 defines a first end 72 and a second opposite end 74. The second switch 70 bar defines oppositely directed faces 76 and 78 extending between the ends 72, 74. The second switch bar 70 includes an electrically conductive region 73 and an electrically insulating region 75. The third switch bar 80 defines a first end 82 and a second opposite end 84. The third switch bar 80 defines oppositely directed faces 86 and 88 extending between the ends 82, 84. The third switch bar 80 includes an electrically conductive region 83 and an electrically insulating region 85.

As previously explained, actuation of the switch 50 is performed by displacement of the switch bars 60, 70, and 80, between the states shown in FIGS. 6 and 8 for example. Specifically, the switch bars 60, 70, and 80 are moved relative to the batteries 16*a*, 16*b* such that in the OFF state shown in FIG. 6, the electrically insulating regions 65, 75, and 85 of the switch bars 60, 70, and 80 respectively, are located adjacent to and in contact with the terminals of the batteries. And, the switch bars 60, 70, and 80 are moved relative to the batteries 16*a*, 16*b* such that in the ON state shown in FIG. 8, the electrically conducting regions 63, 73, and 83 of the switch bars 60, 70, and 80 respectively, are located adjacent to and in contact with the terminals of the batteries.

The present subject matter includes a variety of constructions and/or configurations for the electrically insulating regions 65, 75, and 85; and the electrically conducting regions 63, 73, and 83. For example, in certain embodiments, the electrically insulating regions can be in the form of portions of the switch bars which are formed or coated with electrically insulating materials such as for example many polymeric materials, certain polymer composite materials, rubber or rubber-based materials, and the like. The electrically insulating regions preclude electrical current flow between oppositely directed faces of a switch bar at that location on the switch bar. The electrically conducting regions enable electrical current flow from one face of the respective switch bar to an oppositely directed face of the switch bar at that relative location on the switch bar. Thus, the present subject matter includes switch bars having electrically conductive paths or vias extending through the thickness of a switchbar. Alternatively, or in addition, the present subject matter includes the use of electrical conductors that provide such a path for electrical current between oppositely directed faces of a switch bar, yet which path does not extend through the thickness of a switchbar. This configuration is depicted in the referenced figures in which a metallic clip is placed over an end of each switch bars 60, 70, 80 to provide electrical current flow at a respective end of a switch bar between the oppositely directed faces. A wide array of materials can be used for the electrically conducting materials, such as metals for example including copper, aluminum, and silver.

The switch assemblies of the present subject matter are typically positionable between two states such as an ON state and an OFF state. However, the present subject matter includes switch assemblies positionable between more than two states such as three states, four states, five states, or more. For these embodiments, the switch assemblies can be configured to be linearly displaceable to a corresponding number of different locations. Detents or other provisions could be used to ensure or provide tactile feedback that the switch is positioned to a desired state. The switch bars would include a plurality of electrically conductive regions between ends of each switch bar. Such alternative switch assemblies may find application for selectively actuating additional electrical component(s) in a device of interest, and/or actuating other electrical circuits associated with the device. In addition, it will be understood that the present subject matter includes a wide array of switch assemblies and includes such assemblies with a total of two switch bars, three switch bars as described herein, or four or more switch bars.

In many embodiments of the present subject matter, one or more of the switch bars and/or one or more of the push members are formed by molding or otherwise forming a polymeric or plastic material. In certain versions, the switch bar(s) and the push member(s) are integrally formed with each other. However, the present subject matter includes the use of separate components that are assembled or otherwise engaged with each other to form the switch assembly.

Figure 10:
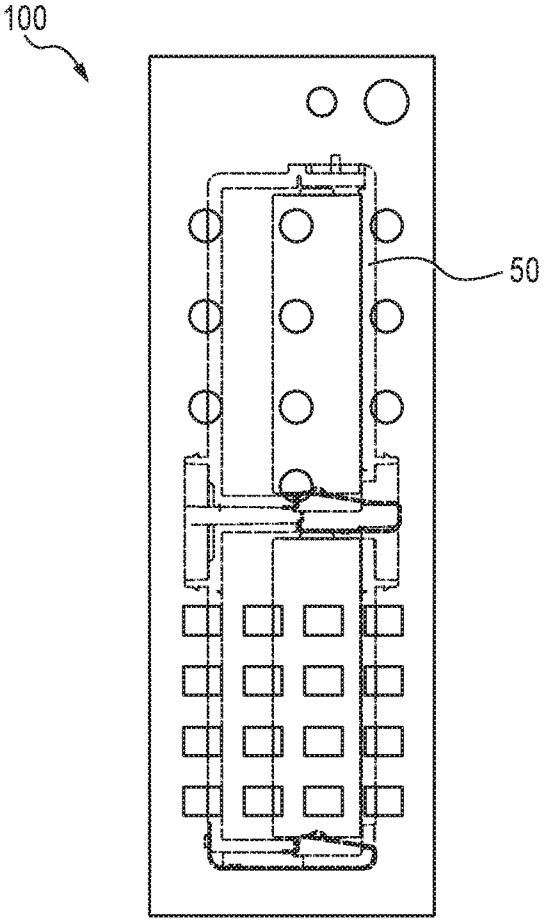
FIG. 10 is a schematic, front elevational view of the remote control device of FIG. 9 and the switch assembly.
Figure 9:
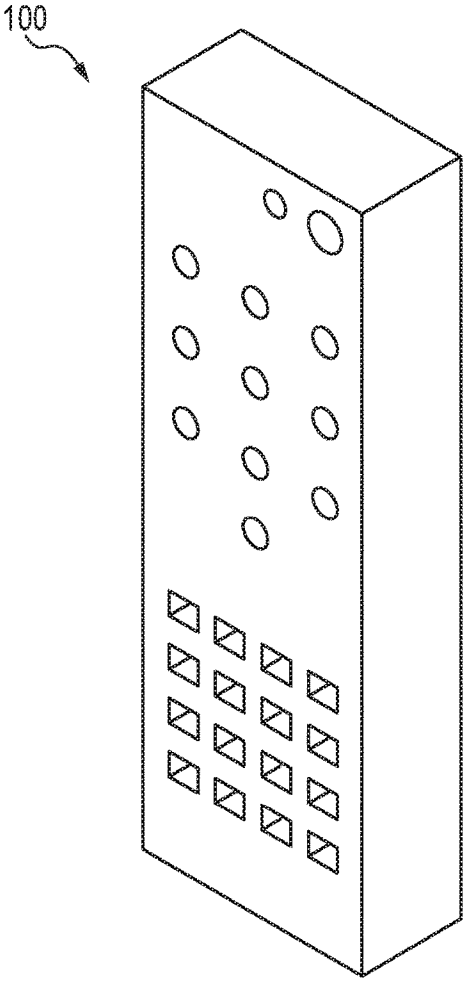
FIG. 9 is a schematic, perspective view of an embodiment of a remote control device utilizing a switch assembly in accordance with the present subject matter.

The various switch assemblies of the present subject matter can be incorporated in a wide array of devices besides flashlights. In many instances, the devices are battery powered and include on-board storage or retaining regions for the batteries. Non-limiting examples of such devices include portable electronic devices, phones, computing or communication devices, electronic games and peripherals, toys, various consumer goods, automotive accessories, industrial devices including monitors, sensors, tools, and related hardware, and scientific hardware. Another example of a battery powered device using the present subject matter switch assembly is a remote control unit. FIGS. 9 and 10 illustrate a remote control unit 100 utilizing the previously described switch assembly 50.

A wide array of batteries can be used in association with the devices and/or switch assemblies of the present subject matter. Typically, the devices and switch assemblies are expected to be used in association with lithium, zinc-carbon, or alkaline cylindrical batteries, such as those commercially available under the designations AAAA, AAA, AA, A, B, C, D, F, N, A23, A27, and others. The present subject matter devices and switches can also be used in association with other battery shapes and types. The battery types can be single-use or disposable; or alternatively rechargeable.

It will be understood that the sizing and/or configuration of the switch assembly depends upon the size and/or type of battery. Referring to FIG. 6 for example, it will be understood that upon incorporation of the switch assembly in a battery powered device, the switch bars 60, 70, and 80 are spaced apart from each other a distance such that upon placement of batteries between the switch bars, the batteries are fittingly engaged between opposing faces of corresponding switch bars. Thus, battery 16*a* is fittingly engaged between the face 68 of the switch bar 60 and the face 76 of the switch bar 70. And, the battery 16*b* is fittingly engaged between the face 78 of the switch bar 70 and the face 86 of the switch bar 80. Upon positioning the switch 50 to each of its different switch states, the batteries which remain stationary relative to the device (not shown in FIG. 6) remain in contact with the noted faces of the moving switch bars.

Many other benefits will no doubt become apparent from future application and development of this technology.

The present subject matter includes all operable combinations of features and aspects described herein. Thus, for example if one feature is described in association with an embodiment and another feature is described in association with another embodiment, it will be understood that the present subject matter includes embodiments having a combination of these features.

As described hereinabove, the present subject matter solves many problems associated with previous strategies, systems and/or devices. However, it will be appreciated that various changes in the details, materials and arrangements of components, which have been herein described and illustrated in order to explain the nature of the present subject matter, may be made by those skilled in the art without departing from the principle and scope of the claimed subject matter, as expressed in the appended claims.

What is claimed is:

1. An electrical switch assembly positionable to a plurality of states, the electrical switch assembly comprising:

a plurality of slidably positionable switch bars, each switch bar defining a first end, a second end opposite from the first end, and oppositely directed faces extending between the first end and the second end, and each switch bar including (i) an electrically conducting region, and (ii) an electrically insulating region;

a first push member engaged with the first end of each switch bar; and a second push member engaged with the second end of each switch bar;

wherein the switch assembly is positionable to an on state by linearly displacing the plurality of the switch bars, the first push member, and the second push member in a first direction, and the switch assembly is positionable to an off state by linearly displacing the plurality of the switch bars, the first push member, and the second push member in a second direction.

2. The electrical switch assembly of claim 1 wherein all of the plurality of switch bars are oriented parallel with each other.

3. The electrical switch assembly of claim 1 wherein the first direction is opposite from the second direction.

4. The electrical switch assembly of claim 1 wherein the plurality of switch bars includes a total of two switch bars.

5. The electrical switch assembly of claim 1 wherein the plurality of switch bars includes a total of three switch bars.

6. The electrical switch assembly of claim 1 wherein the first direction is parallel with a longitudinal axis of any one of the plurality of switch bars, and the second direction is also parallel with the longitudinal axis of any of the plurality of switch bars.

7. A device having a selectively actuated electrical component, the device comprising:

at least one electrical component that is actuatable upon receiving electrical power;

an electrical switch assembly positionable between at least an on state and an off state, and in electrical communication with the electrical component, the electrical switch assembly including (i) a plurality of slidably positionable switch bars, each switch bar defining a first end, a second end opposite from the first end, and oppositely directed faces extending between the first end and the second end, and each switch bar including an electrically conducting region, and an electrically insulating region; (ii) a first push member engaged with the first end of each switch bar, and (iii) a second push member engaged with the second end of each switch bar, wherein the electrical switch assembly is positionable to an on state by linearly displacing the plurality of the switch bars, the first push member, and the second push member in a first direction, and the switch assembly is positionable to an off state by linearly displacing the plurality of the switch bars, the first push member, and the second push member in a second direction.

8. The device of claim 7 further comprising:

an enclosure in which the electrical switch assembly is at least partially disposed, the enclosure defining an interior hollow region for receiving at least one battery.

9. The device of claim 8 wherein the enclosure defines an opening in a wall of the enclosure for providing access to the interior hollow region defined in the enclosure.

10. The device of claim 9 further comprising:

a cover positionable between a closed position in which the cover precludes access through the opening to the interior hollow region, and an open position in which access is enabled through the opening to the interior hollow region.

11. The device of claim 10 wherein the cover is at least partially optically transparent to thereby allow viewing of the interior hollow region through the cover.

12. The device of claim 8 wherein the enclosure defines a first actuator opening along a region of the enclosure and a second actuator opening along another region of the enclosure, the first actuator opening located opposite the second actuator opening.

13. The device of claim 12 wherein the first push member includes a first outwardly projecting actuator, and the second push member includes a second outwardly projecting actuator, the switch assembly disposed in the enclosure such that the first outwardly projecting actuator can be accessed through the first actuator opening, and the second outwardly projecting actuator can be accessed through the second actuator opening.

14. The device of claim 7 wherein the first direction is parallel with a longitudinal axis of any one of the plurality of switch bars, and the second direction is also parallel with the longitudinal axis of any of the plurality of switch bars.

15. The device of claim 7 wherein the device is selected from the group consisting of a flashlight and a remote control.

16. A selectively actuated electrical device comprising:

an enclosure defining an interior hollow region;

at least one electrical component disposed at least partially within the enclosure that is actuatable upon receiving electrical power;

an electrical switch assembly disposed at least partially within the enclosure, the electrical switch assembly positionable between at least an on state and an off state, and in electrical communication with the electrical component, the electrical switch assembly including (i) a plurality of slidably positionable switch bars, each switch bar defining a first end, a second end opposite from the first end, and oppositely directed faces extending between the first end and the second end, and each switch bar including an electrically conducting region, and an electrically insulating region; (ii) a first push member engaged with the first end of each switch bar, and (iii) a second push member engaged with the second end of each switch bar, wherein the switch assembly is positionable to an on state by linearly displacing the plurality of the switch bars, the first push member, and the second push member in a first direction, and the switch assembly is positionable to an off state by linearly displacing the plurality of the switch bars, the first push member, and the second push member in a second direction.

17. The selectively actuated electrical device of claim 16 wherein the enclosure defines a first actuator opening along a region of the enclosure and a second actuator opening along another region of the enclosure, the first actuator opening located opposite the second actuator opening.

18. The selectively actuated electrical device of claim 17 wherein the first push member includes a first outwardly projecting actuator, and the second push member includes a second outwardly projecting actuator, the switch assembly disposed in the enclosure such that the first outwardly projecting actuator can be accessed through the first actuator opening, and the second outwardly projecting actuator can be accessed through the second actuator opening.

19. The selectively actuated electrical device of claim 16 wherein the first direction is parallel with a longitudinal axis of any one of the plurality of switch bars, and the second direction is also parallel with the longitudinal axis of any of the plurality of switch bars.

20. The selectively actuated electrical device of claim 16 wherein the device is selected from the group consisting of a flashlight and a remote control.

* * * * *